US006249988B1

(12) United States Patent
Duske et al.

(10) Patent No.: US 6,249,988 B1
(45) Date of Patent: Jun. 26, 2001

(54) PARTICULATE DRYING SYSTEM

(75) Inventors: Wilfried P. Duske, Franklin, WI (US); Ernest Schmidt, Sheridan, WY (US)

(73) Assignee: Wyoming Sawmills, Inc., Sheridan, WY (US)

( * ) Notice: Subject to any disclaimer, the term of this patent is extended or adjusted under 35 U.S.C. 154(b) by 0 days.

(21) Appl. No.: 09/519,128

(22) Filed: Mar. 6, 2000

Related U.S. Application Data

(63) Continuation of application No. 09/515,341, filed on Feb. 29, 2000, now abandoned.
(60) Provisional application No. 60/184,720, filed on Feb. 24, 2000.

(51) Int. Cl.[7] ..... F26B 19/00
(52) U.S. Cl. ..... 34/62; 34/79; 34/181; 34/210; 122/7 R; 122/422; 432/91
(58) Field of Search ..... 34/60, 62, 63, 34/79, 181, 187, 209, 210; 122/421, 422, 7 R; 432/91

(56) References Cited

U.S. PATENT DOCUMENTS

| | | | |
|---|---|---|---|
| 1,771,141 | | 7/1930 | Renneburg . |
| 2,709,306 | | 5/1955 | Magnusson et al. . |
| 2,715,283 | | 8/1955 | Halldorsson . |
| 2,877,562 | | 3/1959 | Krantz . |
| 3,384,974 | | 5/1968 | Alleman et al. . |
| 3,765,102 | | 10/1973 | Fischer . |
| 3,801,264 | | 4/1974 | Lindl . |
| 4,087,921 | | 5/1978 | Blok . |
| 4,093,505 | | 6/1978 | Tsuruta et al. . |
| 4,177,575 | | 12/1979 | Brooks . |
| 4,392,353 | | 7/1983 | Shibuya et al. . |
| 4,411,074 | | 10/1983 | Daly . |
| 4,445,976 | | 5/1984 | LaDelfa et al. . |
| 4,729,176 | | 3/1988 | Shinn et al. . |
| 4,802,288 | | 2/1989 | Shinn et al. . |
| 4,813,154 | | 3/1989 | Ronning . |
| 5,157,849 | | 10/1992 | Ronning . |
| 5,295,310 | | 3/1994 | Eriksson . |
| 5,588,222 | | 12/1996 | Thompson . |
| 5,603,751 | * | 2/1997 | Ackerson ..... 95/268 |
| 6,092,490 | * | 7/2000 | Bairley et al. ..... 122/7 R |

OTHER PUBLICATIONS

Ardrier Farm and Ranch Dehydrator, Heil Co., Bulletin ARD–55400 (1976).
Duske Rotary Dryer System, Duske Engineering Co., Inc., Bulletin No. 200B (1997).

* cited by examiner

*Primary Examiner*—Pamela Wilson
(74) *Attorney, Agent, or Firm*—Klarquist Sparkman Campbell Leigh & Whinston, LLP

(57) ABSTRACT

A blending chamber for blending fluids used to dry particulate matter has a chamber body with a first inlet opening, a second inlet opening, a third inlet opening, an outlet opening and a blending section. The blending section is arranged in a flow direction downstream of the first, second and third inlet openings, and upstream of the outlet opening. Fluids entering the first, second and third inlet openings are blended together in the blending section before exiting through the outlet opening. The bending chamber may be used to dry sawdust in a system that does not require a dedicated heat source.

14 Claims, 7 Drawing Sheets

132
134
136
194
109
114
107
234
105
4
122
6
5
252
$S_g$
260
105
113
252
113
112
126
112
252
115
6
204
204
4
5

PARTICULATE DRYING SYSTEM

RELATED APPLICATION

This application is a continuation of U.S. patent application Ser. No. 09/515,341, entitled "Particulate Drying System and Method" and filed on Feb. 29, 2000 now abandoned, which claims the benefit of similarly titled U.S. Provisional Patent Application No. 60/184,720, filed on Feb. 24, 2000.

BACKGROUND

The present invention relates to a blending chamber, a drying system and associated methods, suitable for drying particulate materials requiring moisture removal, including, but not limited to, sawdust and wood chips.

Byproducts of manufacturing processes can oftentimes be marketed after additional processing. For instance, in the production of lumber from timber, both wood chips and sawdust are byproducts. These materials have market value which is enhanced when a significant amount of moisture has been removed.

"Green" sawdust refers to sawdust from green or uncured wood, and typically has a moisture content range of 30%–50% by weight. Commercially, sawdust is used in applications such as, for example, manufacturing particle board. For this application, sawdust preferably has a moisture content of 7–15% by weight. Thus, to be commercially viable, the moisture content of green sawdust must be reduced, i.e., the green sawdust must be dried, to reduce the moisture content from 30–50% to 7–15% or less.

Conventional sawdust drying systems have a dedicated heat source used to provide the heat to dry the sawdust. In conventional sawdust drying systems, the drying of the sawdust takes place by convective heat transfer with relatively hot fluids as the drying medium (usually gases, such as air). The costs of operating such a dedicated heat source include fuel and maintenance.

It would be desirable to minimize these costs by using energy (typically heat energy) that is available from associated manufacturing processes, i.e., excess or exhausted heat that has been generated for other purposes. By using such recycled heat to make up at least a portion of the drying heat, and most preferably as the primary or sole source of sawdust drying heat, the costs of drying the byproducts is significantly reduced.

Devices for recycling heat energy from a manufacturing process for use in another processing application are known. U.S. Pat. No. 4,392,353 (Shibuya et al.) discloses a method of recovering heat and particulate matter from exhaust gas which is emitted from a boiler in an electrical power generating device that uses combustible material as fuel. The exhaust gas from the electrical power plant is used to both pre-heat the raw material for a sintering device, and to add ash to the raw material. The output of the sintering device is clinkers produced from calcining raw material, such as cement powder. Although the exhaust gas provides energy to pre-heat the raw material prior to sintering, it is not the primary source of heat for sintering, which is supplied by a dedicated boiler.

U.S. Pat. No. 5,588,222 (Thompson) discloses a process for recycling combustion gases in a drying system. Thompson describes a system for drying material using three combustion chambers, each of which is heated with natural gas. The combustion gases from each of the three combustion chambers are recycled after the pass through a dryer, and are then returned to one or more combustion chambers. The primary objectives of recycling exhaust gases, according to Thompson, are (1) to oxidize pollutants, (2) to decrease $O_2$ levels in the dryers to reduce fire hazard, and (3) to limit thermal degradation of dried material.

It would be desirable to provide a drying system and methods suitable for drying sawdust, as well as other particulate materials, that makes use of heat generated for other purposes as a primary source of energy for drying purposes. The provision of improved drying apparatus is also desirable.

SUMMARY

The present invention, as exemplified by a number of embodiments described herein, has particular applicability to the drying of particulate materials, such as sawdust. Sawdust refers to small wood particulate materials generated from sawing, grinding or otherwise processing logs, lumber and wood and may also include particulate materials generated by sanding operations. Sawdust typically has a particulate size varying from about 0.0625 in to about 0.125 in in cross-sectional dimension. The term particulate materials includes larger materials such as wood flakes and chips, although such larger materials are excluded from the definition of sawdust. According to a specific embodiment of the invention, the particulate materials to be dried are sized to pass through a 1 ½ in square screen.

According to embodiments of the invention, a blending chamber for use in a system for drying particulate materials such as sawdust or other particulate materials uses, as its primary source of heat, excess heat or exhaust heat from a heat source used for purposes other than particulate drying.

For example, relatively hot exhaust gas from a boiler or other heat source can be used as a heat input to the blending chamber. Additional heat input to the blending chamber can be derived by heating ambient air with a heat exchanger through which steam generated for another operation is circulated. Such steam may also be produced by the same boiler that produces the exhaust gas. The boiler preferably is the primary source of heat for a process other than particulate drying. Thus, excess or waste heat is desirably used from the boiler rather than a dedicated heat source for particulate drying.

If necessary, these one or more "hot" inputs to the blending chamber, e.g., the exhaust gas from the boiler and the heated air, can be cooled to provide an output stream at an appropriate temperature for a particulate drying operation. For example, relatively cool air, such as ambient temperature air (from the exterior environment outside of the blending chamber, i.e., a "cold" input) may be added to the hot gas inputs before, simultaneously with, or after mixing the hot inputs together. There may be applications in which the "hot" inputs are the appropriate temperature, and a "cold" input is not required.

Particulate material to be dried may be added to the output stream exiting the blending chamber and carried by the blended output stream to a dryer. After the material is dried in the dryer, the output stream may carry the now at least partially dried particulates to a separator, wherein the dried material is separated from the output stream. As an alternative to this continuous drying process, a batch drying approach, although less desirable, may be used.

The output stream temperature may be monitored for desired drying performance. A feedback-type control arrangement may be used in which the amounts of the hot and cold streams are varied with respect with each other to achieve a desired output stream temperature. In one specific example, the mass flow rate of gas in the output stream is maintained substantially constant. In this case, an increase in the amount of the hot streams blended into the output stream is accomplished by a corresponding decrease in the amount of the cold stream blended into the output stream, and vice versa.

The blending chamber preferably uses excess heat, and thus is relatively inexpensive to operate. Further, the drying process may take place at relatively low temperatures, and may be controlled to limit thermal degradation of the product being dried. In the case of drying sawdust and other wood particulates, if low temperature drying is used, the production of volatile organic compounds is virtually eliminated.

With the drying system, the moisture content in the dried product can be substantially controlled, such as to within 1½% by weight. Also, in the case wherein the drying system is attached to a boiler, the drying process need not interfere with the draft on the boiler.

These and other features and advantages of the embodiments will be apparent from the drawings and following detailed description. The invention is directed to new and non-obvious features of systems, components and methods both alone and in combination with one another as set forth in the claims below. Not all advantages need be present in an embodiment for the embodiment to be included in the present invention.

DETAILED DESCRIPTION

According to several embodiments of the invention, a blending chamber for use in a drying process (e.g., to dry sawdust or other particulate materials) blends together relatively hot and cold fluid streams into a blended output stream. In the overall drying system, this blended output stream may be drawn by a fan or otherwise propelled to carry the material to be dried (e.g., green sawdust) through a dryer, at which point the dry material is separated from the output stream. Green sawdust refers to sawdust obtained from processing lumber or logs before the lumber has been kiln or otherwise dried to a low moisture content (e.g. green sawdust has a moisture content of from about 30 to about 50% by weight). There may be two or more hot streams, and these hot streams may be heated with unused or excess heat energy from associated systems used to provide heat for processes unrelated to drying the particulate materials, such as exhaust gas and steam. Thus, the hot streams may be heated with "recycled" heat and not require a separate, dedicated heat source. It is desirable that a majority of the heat (over 50%) used in drying particulates be obtained from a non-dedicated heat source. More desirable still is to obtain substantially all (e.g., in excess of 80%) of the heat used for drying the particulates is from a non-dedicated heat source. Most preferably all, or all but an insignificant amount of the heat for drying the particulates, is derived from non-dedicated heat source. A non-dedicated heat source is one that is the primary heat source for a process (e.g. for a lumber or veneer drying kiln) other than drying the particulates.

In the blending chamber of the illustrated drying system, the temperature of the blending output stream may be monitored to optimize drying, with the relative amounts of the hot and cold streams being adjusted accordingly. For instance, the cold stream may be ambient temperature air that is admitted into the blending chamber to offset the high temperature hot stream(s) and thereby decrease the resulting blended output stream temperature. The temperature may be maintained low enough to minimize or virtually eliminate the production of volatile organic products from the drying particulates. The amounts of the hot and cold streams admitted into the blending chamber may be controlled, for example such that the output stream mass flow rate remains substantially constant. The temperature may be controlled such that the moisture content of the product remains relatively constant.

OVERALL DRYING SYSTEM

Figure 8:
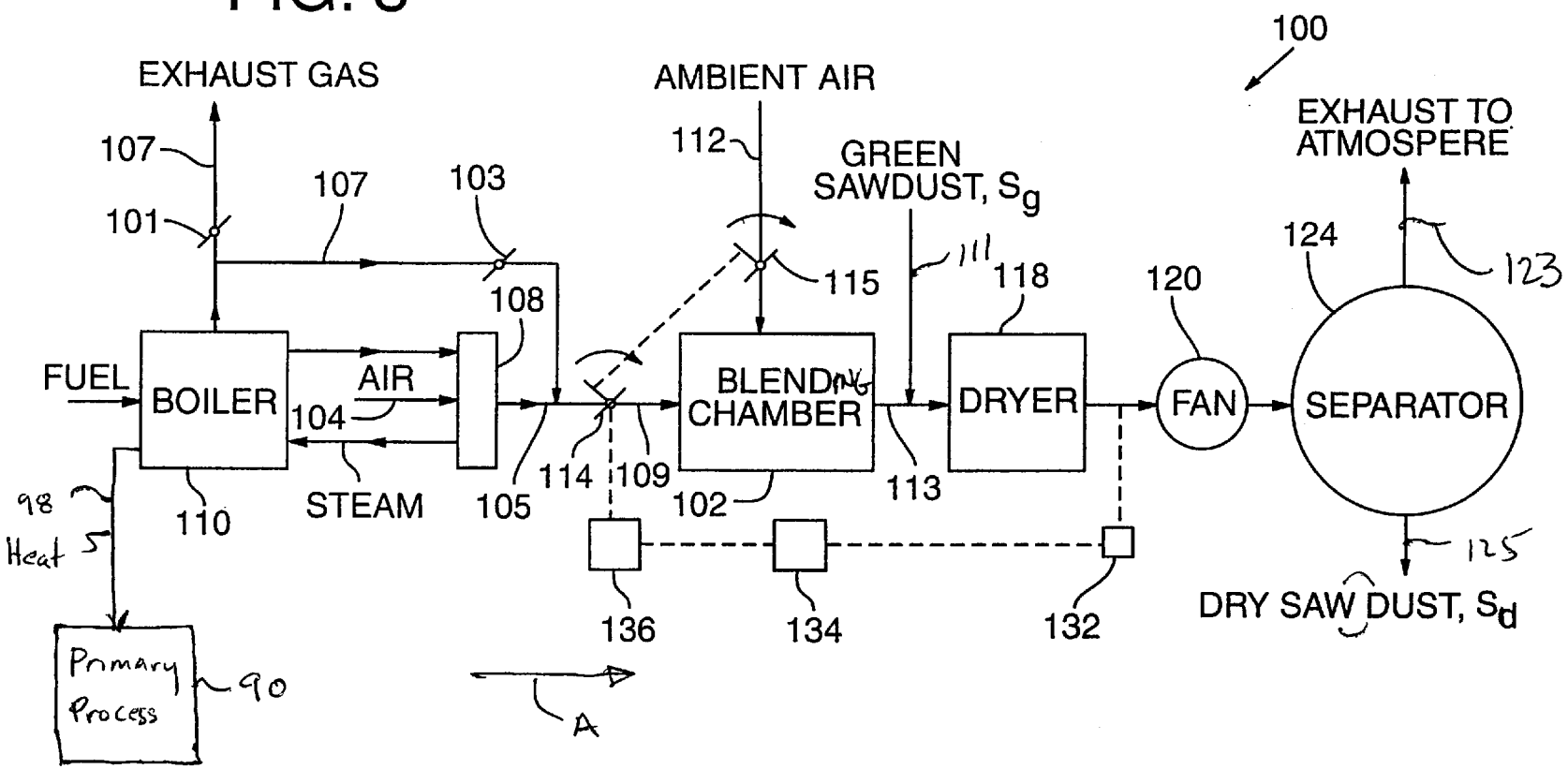
FIG. 8 is a schematic block diagram of an embodiment of the drying system.

A specific implementation of an embodiment of a drying system 100 is shown in the schematic block diagram of FIG. 8. In general, a blended output stream 113 of fluids from a blending chamber 102 is drawn into a dryer 118 under the action of a fan 120. Before the output stream enters the dryer 118, particulate material to be dried, such as green sawdust, is added, such as at 111, and is carried by the output stream into the dryer 118. After the material is dried, it is drawn out of the dryer 118 and into a separator 124, still carried by the output stream under the action of the fan 120. In the separator 124, which may be a conventional cyclone separator, the dried material is separated from the output stream, which is now higher in moisture content as a result of the drying process. The moist output stream is exhausted at 123 to the atmosphere. The dried material is collected at 125. Although it is possible to use a scrubber or other pollution control device to clean the exhaust 123, this is typically unnecessary in the case of low temperature drying of sawdust. The blending chamber 102, dryer 118, fan 120 and separator 124 are also shown pictorially in FIGS. 1B, 2A and 2B. As shown, the drying process proceeds in a general process direction A from left to right.

As stated, the blending chamber 102 blends together relatively "hot" and "cold" fluids to achieve a desired temperature of the blended output stream. In one specific implementation, the fluids that are blended together are gases from three sources: (1) an exhaust gas stream 107, e.g., from a boiler 110 exhaust stack; (2) a heated air stream 105 (e.g., from an air stream 104, such as ambient air, that is heated by a heat exchanger 108); and (3) a relatively cold air stream (e.g. colder than streams 104, 105) such as an ambient temperature air stream 112.

The exhaust gas stream 107 is combined with the heated air stream 105, thereby creating a combined stream 109, which flows through the blending chamber 102. The streams 105 and 107 may also be mixed together in a mixing section of the blending chamber. The relatively cold air stream 112, which again may be at ambient temperature, is added to the combined stream 109. Subsequently, the combined stream 1 09 and the air stream 112 are blended together into the blended output stream 113.

In a specific implementation, control of the drying process includes varying the proportions of the combined stream 109 (or a single hot gas stream or more than two such streams if alternatives are used) and the air stream 112 relative to each other. As shown, the flow of the combined stream 109 may be controlled by a first flow controller or flow control device 114, and the air stream 112 may be controlled by a second flow controller or flow control device 115. The flow control device 115 may be mechanically interlinked with the first flow control device 114 as shown. Electronic interlinking or other simultaneous or independent control approaches may also be used. Further details of an exemplary control of the illustrated drying system 100 are discussed below The exhaust gas stream 107 from the boiler 110 has a typical temperature range from about 300° F. to about 500° F. The heated air stream 105 has a typical temperature range from about 100° F. to about 400° F. Relative to the ambient temperature in the area surrounding the system 100, which may range from about 0° F. to about 100° F. while the system is operating, the temperatures of the exhaust gas stream 107 and the heated air stream 105 are higher. Thus, the exhaust gas stream 107 and the heated air stream 105 can be considered first and second "hot" fluid or gas inputs to the blending chamber 102. Correspondingly, the air stream 112 can be considered a "cold" fluid or input, (cold relative to the temperature of the exhaust gas stream 107 and the heated air stream 105). It should again be noted that one or more heated fluid sources may be used in the system. For example, the exhaust gas stream 107 may be used alone, the heated air stream may be used alone (although less desirable), or other sources may be used (which is also less desirable).

In the illustrated implementation, although separate heat sources may be used, both of the "hot" inputs to the blending chamber 102 derive their heat from a single source, i.e., the boiler 110. The exhaust gas is produced as a byproduct during the normal operation of the boiler 110 from, e.g., the combustion of fuel. Heat from the boiler 110 is the primary source of heat for another process 90, such as a lumber or veneer drying kiln, with such heat being shown schematically as being delivered to the kiln along a pathway 98. The heated air (if used) is produced by warming air such as ambient air with at least one heat exchanger 108. Steam produced by the normal operation of the boiler 110 circulates through the heat exchanger 108 and releases heat. Typically, the boiler has a capacity to produce excess heat, i.e., heat in excess of the amount required for the primary process. The released heat warms air being drawn through the heat exchanger 108.

Moreover, both the exhaust gas stream 107 and the heated air stream 105 may be "recycled" heat sources. As illustrated, the exhaust gases are produced as a byproduct of normal operation of the boiler 110, and are conventionally exhausted to the atmosphere (directly or through pollution control devices). Thus, the heat exchange used to produce the heated air stream 105 in the illustrated embodiment takes advantage of an existing heat or steam source, and does not require an additional boiler other energy source.

The process shown in FIG. 8 is a continuous process. However, although less desirable, the dryer system may operate on a batch basis. Alternative approaches for delivering particulates to the dryer other than using the blended stream 113 may also be used, although less desirable.

BLENDING CHAMBER

Figure 6:
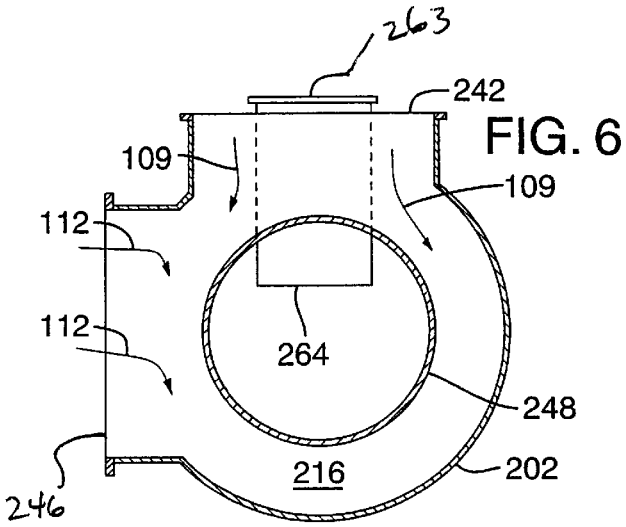
FIGS. 5 and 6 are sectional views of the blending chamber of FIG. 3, taken along lines 5—5 and 6—6 of FIG. 3, respectively.
Figure 4:
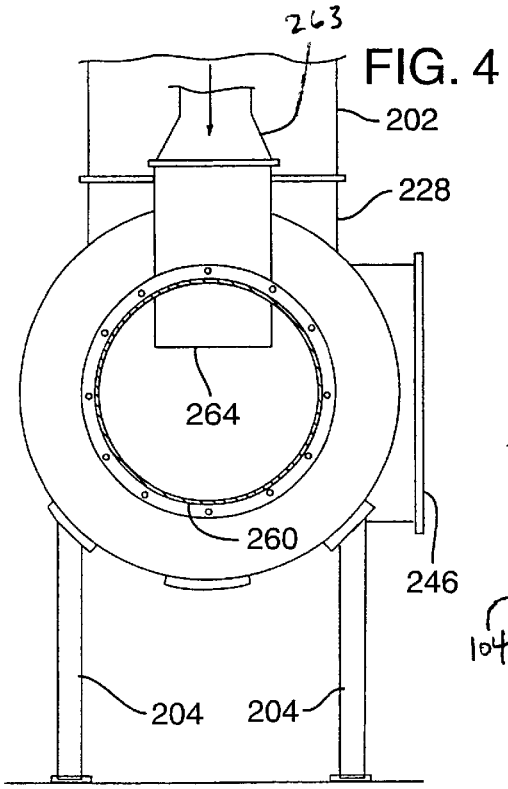
FIG. 4 is an end view of the blending chamber of FIG. 3, taken along line 4—4 in FIG. 3.
Figure 7:
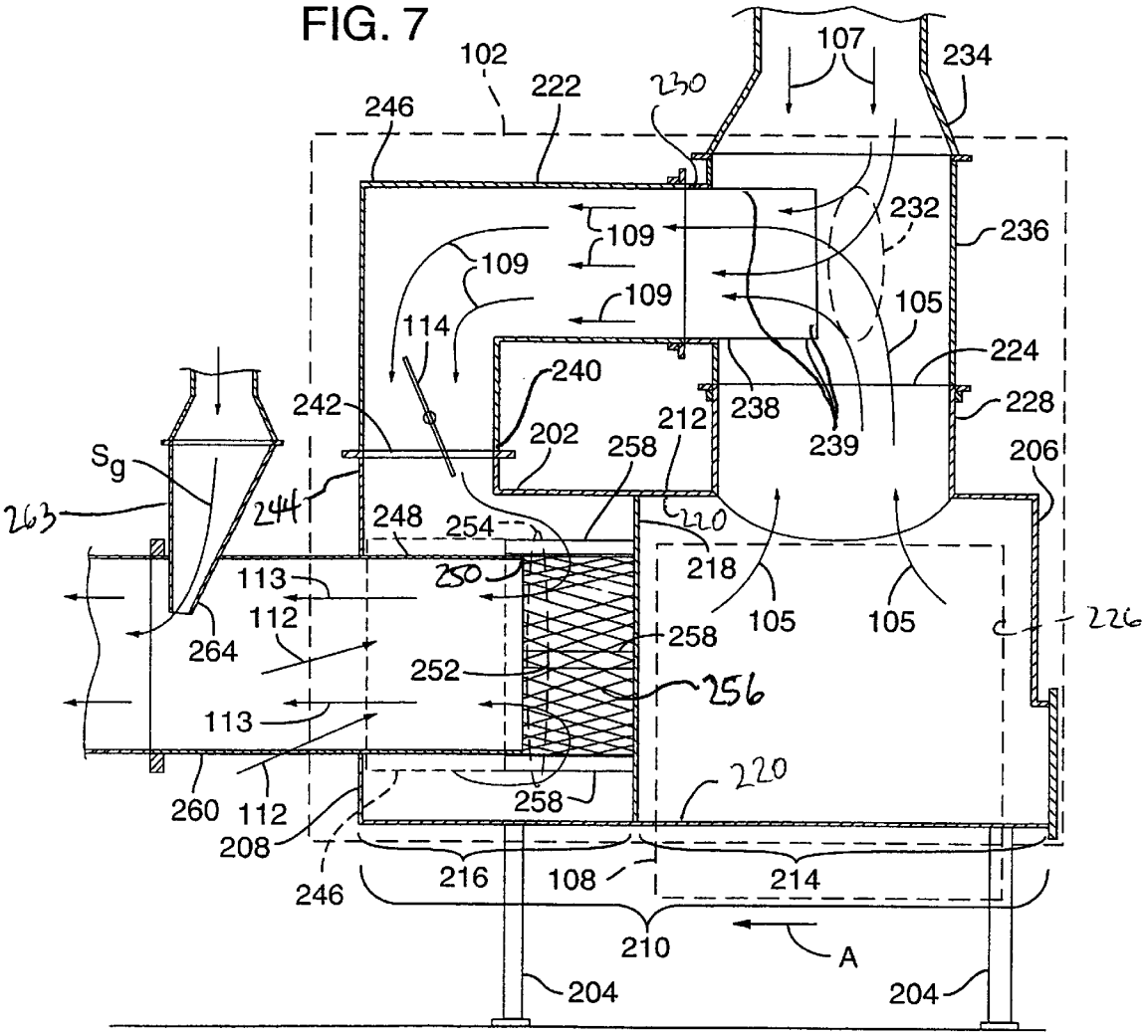
FIG. 7 is a vertical sectional view of a form of blending chamber taken generally along line 7—7 of FIG. 5.

FIGS. 4–7 show an exemplary embodiment of a blending chamber 102 in greater detail. The blending chamber need not take the from shown in these figures. The orientation of the blending chamber in FIG. 7 is reversed from the orientation of FIG. 1B, and thus the process direction A in FIG. 7 extends from right to left.

As shown in FIG. 7, the illustrated blending chamber 102 includes a body 202 having a first end 206 (at the right side of FIG. 7), a second end 208 (at the left side of FIG. 7), and a middle section 210 with a generally curved outer surface 212 extending between the first end 206 and the second end 208. The body 202 maybe supported above the ground, a floor or other supporting surface by one or more legs 204.

The interior of the body 202 is divided into a first mixing or hot gas receiving section or portion 214 and a second blending section or portion 216 by a vertically extending bulkhead 218 welded or otherwise secured to an inner surface 220 of the body 202. Thus, the first portion 214 is arranged adjacent the first end 206, and the second portion 216 is arranged adjacent the second end 208.

Still referring to FIG. 7, a passageway 222 positioned above the body 202 connects the first portion 214 to the second portion 216. The body 202 has a first opening 224 formed in an upper surface adjacent the first end 206 and a second opening 226 (shown in dashed lines) formed in its side surface below the first opening 224. As illustrated, the first opening 224 may be defined by a cylindrical neck 228 extending upwardly from the body.

Figure 5:
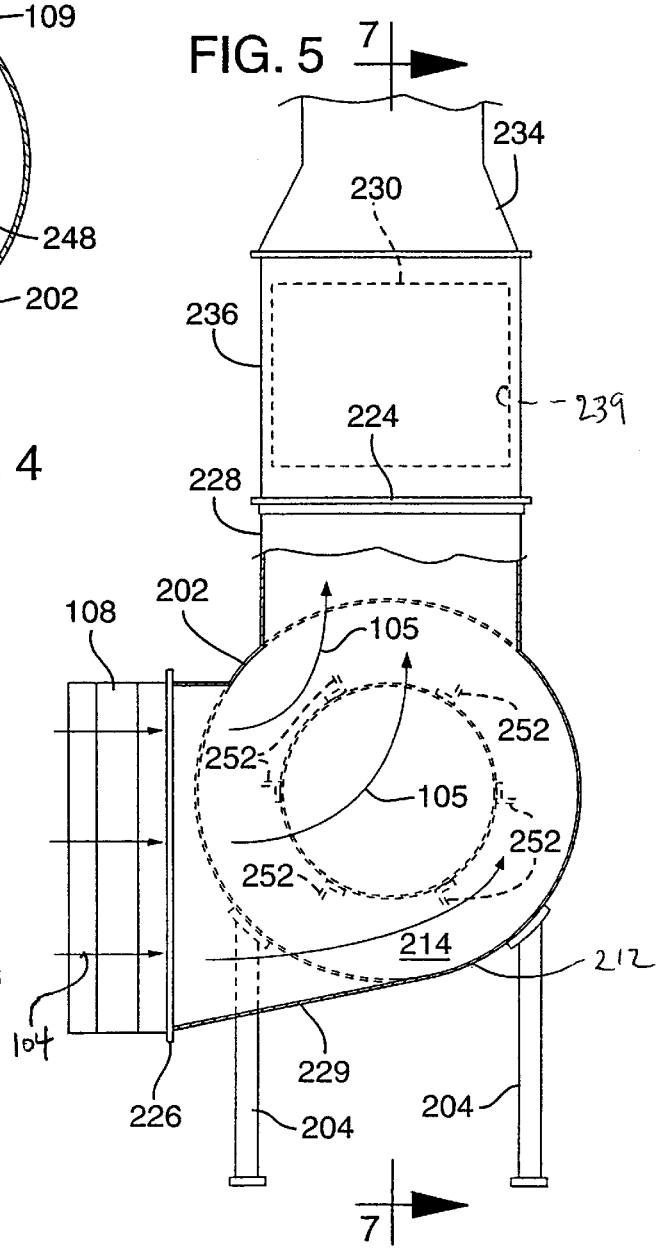

As illustrated best in FIG. 5, the second opening 226 is sized to receive the heat exchanger 108, and is defined by an adapter portion 229 that extends from the outer surface 212 of the body 202. The adapter portion 229 channels the flow of the heated air stream 105 from the heat exchanger 108 into the first portion 214 of the body 202 (as indicated by arrows 105). The adapter portion 229 decreases in cross-sectional area from about the size of the heat exchanger 108 (at the second opening 226) to a smaller cross-section where the adapter portion 229 meets a cylindrical portion of the illustrated body 202.

Referring again to FIG. 7, at a first end 230 of the passageway 222, the two "hot" inputs to the blending chamber 202 are joined at a first junction 232 of flows. The blending chamber 202 has a connection portion 236 having an upper end attached to an exhaust gas inlet passageway 234 and a lower end connected to the first opening 224. Specifically, (1) the exhaust gas stream 107 flows downwardly through the exhaust gas inlet passageway 234 and the connection portion 236 into a "hot" gas input end 238 of the passageway 222; and (2) the heated air stream 105 flows laterally from the heat exchanger 108 and into the first portion 214, through the second opening 226, and then upwardly through the first opening 224 and the connection portion 236 into the "hot" input end 238 of the passageway 222. The end 238 thus comprises a form of hot gas outlet of the hot gas mixing section 214 of the blending chamber.

As illustrated, the "hot" input or first end 238 of the passageway 222 is connected to the connection portion 236. The lines 239 in the FIG. 7 sectional view show the junction of the first end 238, which is rectangular in the specific embodiment, with the connection portion, which is cylindrical in the specific embodiment.

Still referring to FIG. 7, the passageway 222 has a second end 240 opposite the first end 230 that is joined to the body 202 adjacent the blending chamber second end 208. The illustrated passageway 222 has a generally constant rectangular cross section between the first end 230 and the second end 240. Between the first end 230 and the second end 240, the passageway 222 has an elbow 246 that directs the combined stream 109 flowing horizontally from right to left (FIG. 7) in a downward direction toward the body 202. The body 202 has a third or hot gas receiving inlet opening 242 formed in its upper surface, which may be defined by a neck extension conduit section 244 as shown, and is connected to the second end 240 of the passageway 222.

The body 202 has a fourth opening 246 formed in a side surface or side wall adjacent to and below the third opening 242. The cool air stream 112 enters the blending section or second portion 216 of the body 202 through the fourth opening 246 (as indicated by arrows 112 as best seen in FIG. 6). The fourth opening 246 may be generally rectangular in shape, and may correspond to the shape of the second flow control device 115 (FIG. 8) that controls the flow of the air stream 112.

Again referring to FIG. 7, in the blending section or second portion 216 of the body 202, the combined hot gas stream 109 and the air stream 112 are received, blended together into the blended output stream 113, and conveyed out of the blending chamber 210. An extension 248 or conduit may extend inwardly into second portion 216 from the outlet opening at the second end of the body 202 into a central area of the second portion 216. As illustrated, the extension 248 may be an inwardly extending portion of an outlet pipe 260 that connects the blending chamber 102 to the dryer 118. The extension 248 has an end 250 that defines an outlet opening 252.

A blending junction or zone 254 is thus provided in the second portion 216 between the end 250 and the bulkhead 218. In addition, a turbulence enhancer 254 may be included in the blending zone to increase the turbulence and mixing of gas streams of 109, 112. In the illustrated implementation, the turbulence enhancer 254 is a perforated ring or screen 256 that is mounted to or otherwise attached to the end 250 and extends between the end 250 and the bulkhead 218. For example, the turbulence enhancer may be a mesh screen. In a specific embodiment, the screen is constructed of ¾×#9 expanded steel. The perforated ring or screen 256 is supported by one or more members 258.

When the combined stream 109 and the air stream 112 enter the second portion 216 through the third and fourth openings 242, 246, respectively, they encounter the solid surface of the outlet extension 248 (see FIG. 6). The streams 109, 112 are directed opposite the general process direction. In other words, the streams 109, 112 are forced to flow rightwardly as shown in FIG. 7, whereas the general process direction A in FIG. 7 is leftward. Also, the cross sectional dimension of that portion of the flow path where the streams 109, 112 are forced to flow rightwardly is constricted. After flowing rightward along the outlet extension 248, the streams 109, 112 encounter the perforated ring 256. The streams 109, 112 then begin to flow through the openings in the perforated ring 256, blending together with each other.

By being blended together, temperature stratification between the streams is substantially reduced, and the temperature of the blended output stream is nearly uniform. As the streams continue blending together, they reverse flow and begin to move leftward again, in the general process direction, as they pass through the outlet opening 252 and into the outlet extension 248 before exiting from the outlet of the blending chamber 110. Thus, the streams are forced to flow along a tortuous path in the second portion, and, specifically, a flow path that reverses direction (i.e., from left to right, then from right to left, as shown in FIG. 7). Also, gas streams 105, 107, flow through angles totaling in excess of 450° as they pass through the blending chamber.

The area adjacent the outlet opening 252 and the adjoining perforated ring is thus one example of a second junction 254 within the blending chamber 102 where the combined stream 109 and the fresh air stream 112 are joined together.

RAW MATERIAL INTRODUCTION

The output stream 113 exiting the blending chamber 102 passes through the outlet pipe 260, such as under the action of the fan 120.

As illustrated in FIG. 7, a particulate material introducer, e.g., comprising a hopper 263 adds sawdust and/or other particulate material to the blended gas stream, in this case downstream of the blender and upstream of the dryer. In one specific form, a hopper 263 has an outlet tip 264 which is inserted into and connected to the outlet pipe 260 downstream of the blending chamber 102. The tip 264 of the hopper 263 (see also FIGS. 4 and 6) projects inwardly toward a central area of the outlet pipe 260. Green sawdust, indicated in FIG. 7 as $S_g$, is introduced into the outlet pipe 260, such as under the action of gravity and the passing output stream 113. The output stream 113 flows approximately perpendicular to the green sawdust flow $S_g$ from hopper 263, tending to draw the green sawdust into the outlet pipe 260 by the Bernoulli effect. As green sawdust $S_g$ enters the outlet pipe 260, it is carried into the dryer 118 by the output stream 113.

An approach for supplying raw particulate material to the hopper 263 is described below.

DRYER

Figure 1A:
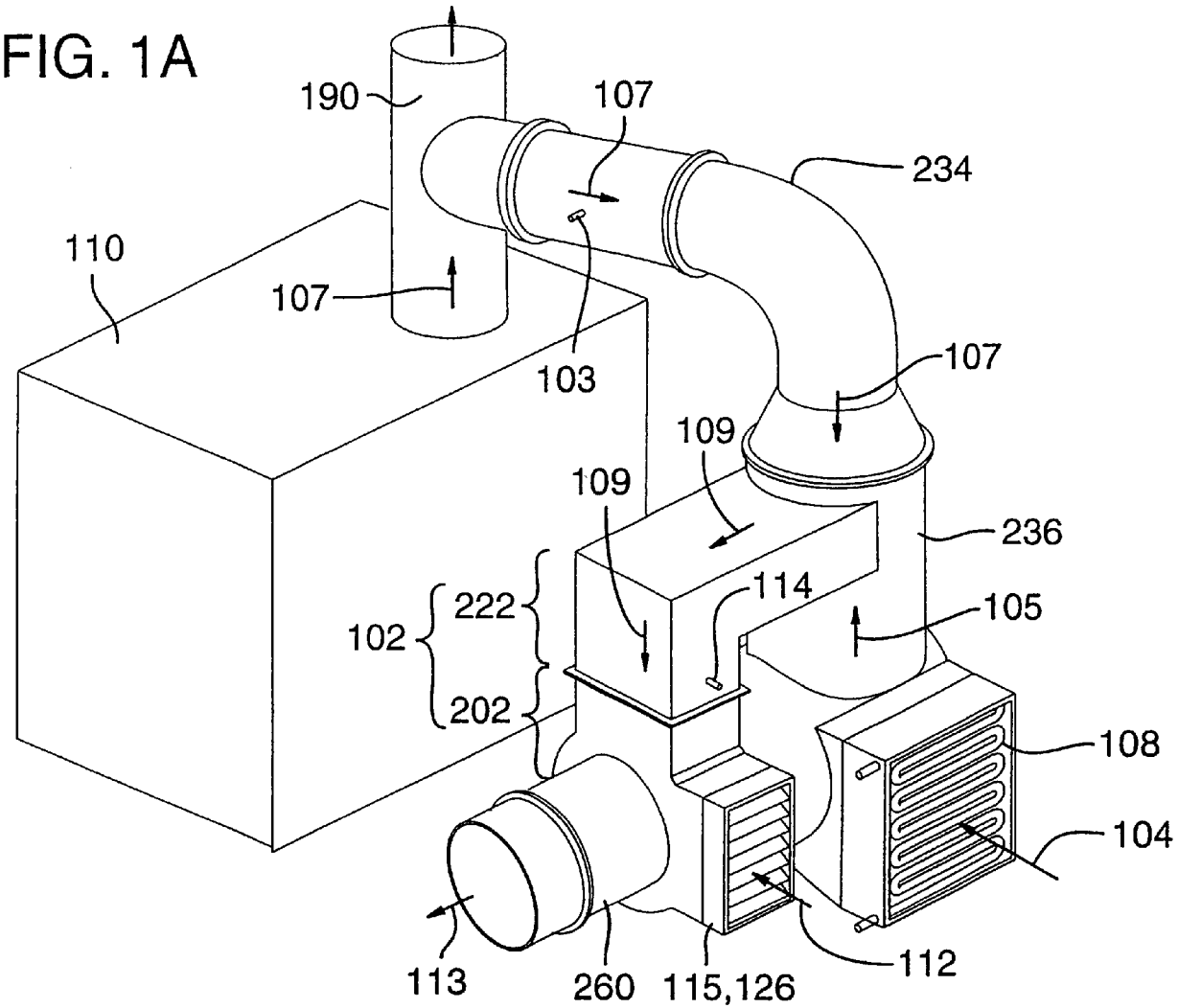
FIG. 1A is a perspective view of a blending chamber according to one implementation showing the exhaust gas flow from a representative boiler to an embodiment of a blending chamber.
Figures 1B, 1C:
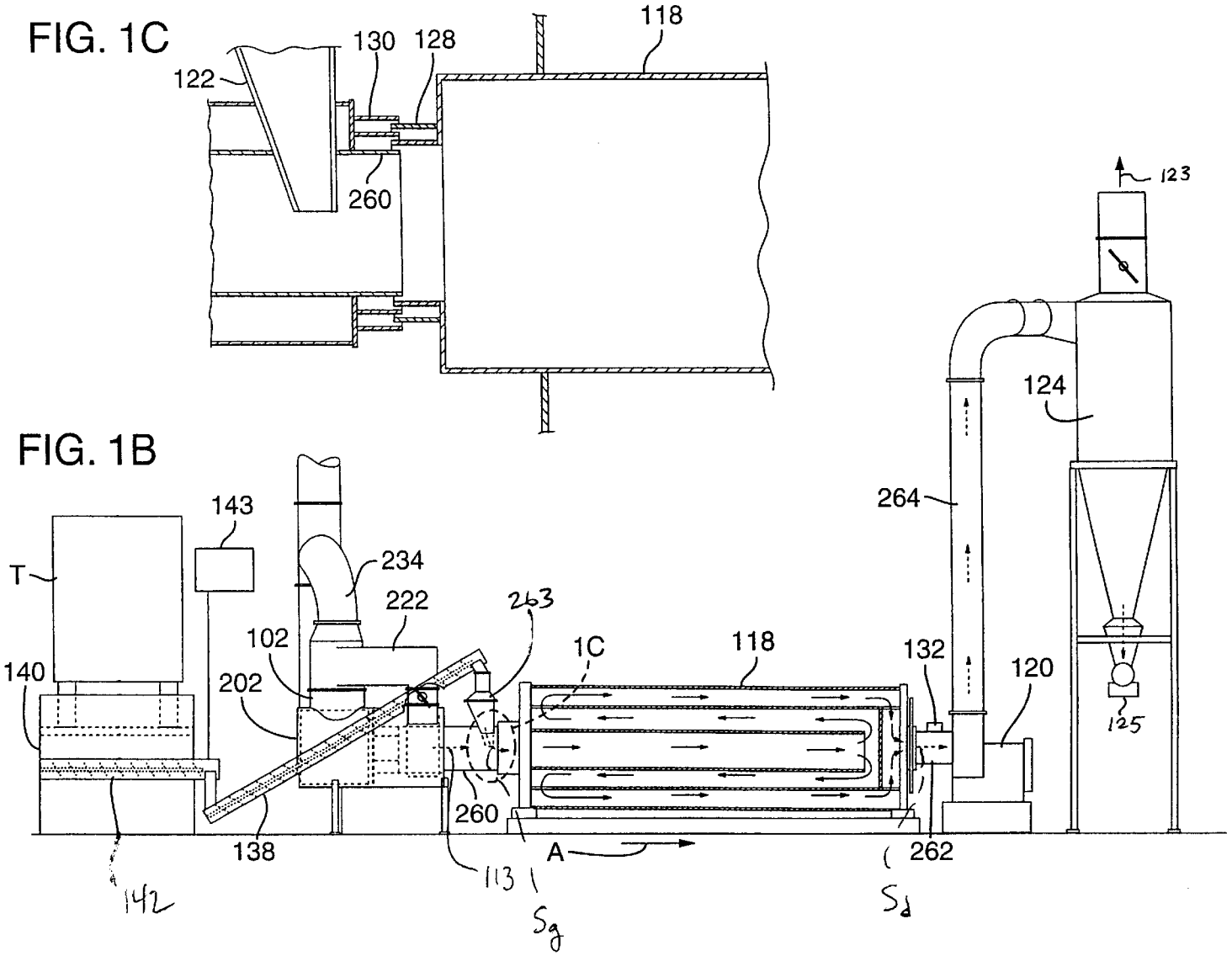
FIG. 1B a side elevational view of an embodiment of a drying system that includes, in a general process direction from left to right, the blending chamber of FIG. 1A, together with one form of a dryer, a fan, a separator and an apparatus for inputting material to be dried into the system.
FIG. 1C is an enlarged vertical sectional view of a portion of the drying system of FIG. 1B showing the coupling between an outlet pipe leading from the blending chamber to the dryer.
Figure 2A:
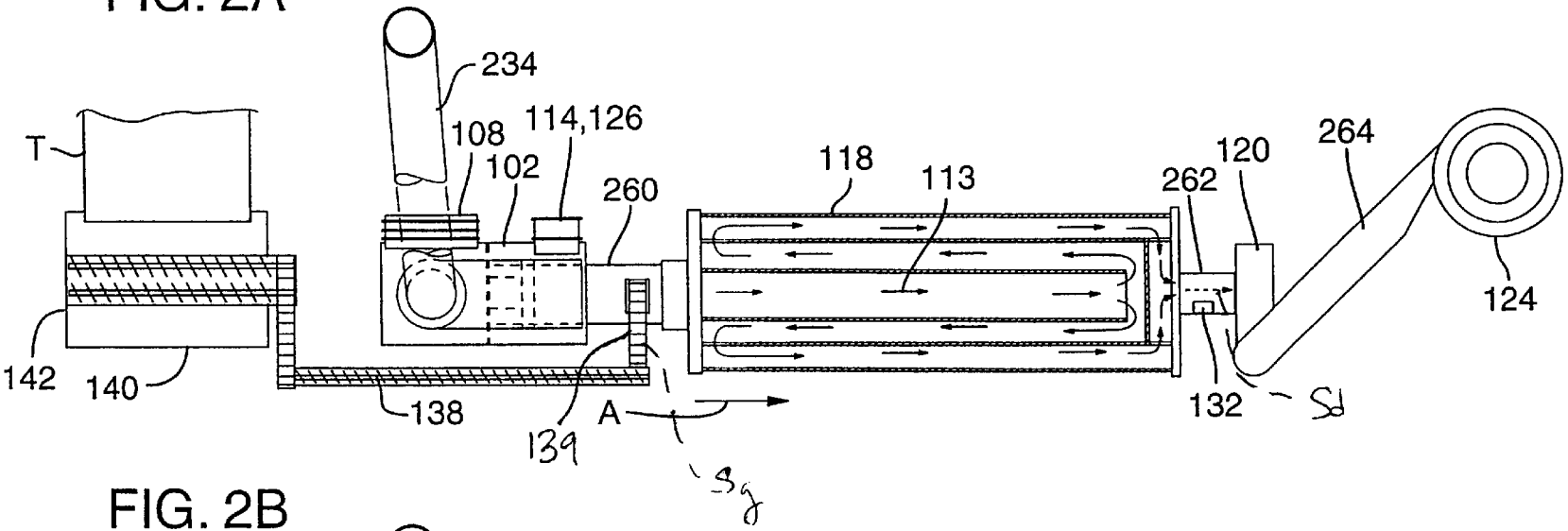
FIG. 2A is a side elevational view of another embodiment of a drying system.

The output stream 113 in this embodiment carries the green sawdust $S_g$ to and through the dryer 118. In a specific implementation, and as shown in FIGS. 1B and 2A, the dryer 118 may be a conventional rotating drum dryer with a three-pass configuration. Alternatively, dryers having different configurations, such as the single-pass dryer 118 shown in FIG. 2B, may be used in place of the dyer 118. Dryers having configurations with fewer passes generally must be greater in length to have the same performance as the three-pass dryer 118. For example, the single-pass dryer 118 typically must have an overall length of approximately three times the length of the three-pass dryer 118 to have the same performance. Batch processing dryers with particulate added to the dryer may be used, although less desirable.

An embodiment of the three-pass dryer 118, which was manufactured by Duske Engineering of Franklin, Wisconsin and uses a drum manufactured by Heil Company, is approximately eight feet in diameter and 24 feet long. As shown schematically in FIGS. 1B and 2A, the output stream 113 carries the green sawdust $S_g$ and/or other particulate material into and through the dryer 118, with the flow path reversing directions between each of the three passes. At the same time, the dryer 118 is driven by an external drive (not shown) to rotate such as at a predetermined speed.

The illustrated dryer 118 has three concentric cylinders as shown in FIG. 2A, each having longitudinal flights that repeatedly lift and shower the green sawdust $S_g$ into the output stream 113. As the green sawdust $S_g$ is carried through the dryer 118, the output stream 113 continues to dry it. At the exit of the dryer 118, the sawdust, which is referred to as the dried sawdust $S_d$, is carried by the output stream 113 toward the fan 120.

As shown in FIG. 1C, the dryer 118 may have a rotating flange 128 with a mating stationary flange 130 on the downstream end of the outlet pipe 260, thus minimizing loss of temperature and mass flow at the junction between the outlet pipe 260, which in this example does not rotate, and the rotating dryer 118. Other details of the construction and operation of the dryer 118, which is conventional, are readily apparent to those of ordinary skill in the art.

FAN

As illustrated in FIG. 1B, the fan 120 in this embodiment is positioned downstream of the dryer 118, and is connected to the dryer by a connecting pipe 262. The fan 120 could also be positioned downstream of the separator 124, e.g., to prevent the dried product from abrading the fan blade. As described above, the fan 120 creates a negative pressure that draws the various fluid streams into the blending chamber, draws the green sawdust flow $S_g$ into the blended output stream 113, and draws the output stream 113 carrying the green sawdust $S_g$ through the dryer 118.

After the output stream 113 carrying dried sawdust $S_d$ exits the dryer 118, the fan 120 forces it upward along a connecting duct 264 to the separator 124.

The flow rate of sawdust and/or other wood particulates may vary. Typical flow rates for sawdust entering the dryer at a moisture content of from about 30% moisture to about 70% moisture, with about 50% being a specific example and exiting the dryer with a moisture content of from about 1% moisture to about 50% moisture, with about 15% moisture being a specific example, are from about 2000 lbs/hr to about 5000 lbs/hr, with a specific example being about 2100 lbs/hr. This is with a blended air stream 113 at a temperature of about 320° F. at the exit to the dryer.

In a specific embodiment, the fan 120 is a conventional fan capable of providing a sufficient operating range, as would be known to one of skill in the art. One specific example of suitable fan is the Model 404 GI Fan manufactured by New York Blower Co. of Willowbrook, Ill. This fan has an operating range of 10,000 to 15,000 cfm.

SEPARATOR

Dried sawdust $S_d$ is carried by the output stream 113 along a connecting duct 264 to the separator 124. After exiting the dryer, the output stream 113 has increased moisture content from the drying operation (i.e., moisture from the green sawdust $S_g$ has been transferred to the output stream 113).

In the illustrated separator, the desired product, i.e., the dried sawdust $S_d$, is separated from the moist output stream 113 and collected. In addition, the separator exhausts the moist output stream 113, such as to the atmosphere.

In a specific implementation, the separator 124 is a conventional cyclone separator. One example of a suitable separator is the Model TPD-4000 manufactured by Duske Engineering of Franklin, Wis.

RAW MATERIAL SUPPLY

Figure 2B:
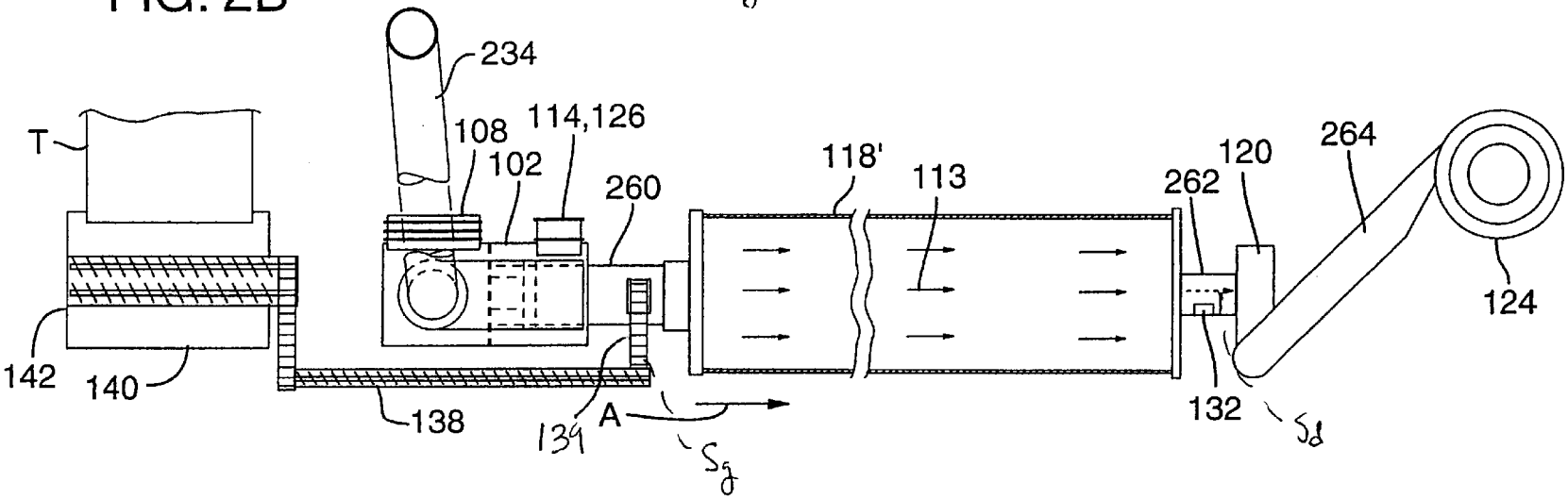
FIG. 2B is a side elevational view similar to FIG. 2A, except that FIG. 2B shows a single pass dryer of another embodiment of a drying system.

Raw material (e.g., the green sawdust $S_g$ to be dried) can be supplied for introduction into the blended output stream using any conventional apparatus. A specific implementation of exemplary particulate deliverer apparatus is shown in FIGS. 1B, 2A, and 2B.

As shown, green sawdust $S_g$ or other particulates are dumped or unloaded from a loader, a truck T or other source into a surge bin 140. The illustrated surge bin 140 has a twin auger output 142 with a variable speed frequency drive (not shown) linked to a frequency drive controller 143 to control the volume of green sawdust being fed into the drying system. Optionally, the green sawdust may be ground to a substantially uniform maximum size in a conventional grinder or hog (not shown) prior to delivery to the surge bin or prior to conveyance to the hopper 263. The grinder would reduce the size of larger wood pieces that happen to be in the sawdust. An auger conveyer 138 or other material transporter, such as a belt 139 (FIGS. 2A, 2B), may be used to transport the particulates to the hopper 263.

CONTROL SYSTEM

Referring again to FIG. 8, the drying system 100 may include various controls to ensure that the green sawdust $S_g$ is sufficiently dried yet not burned, and that only needed energy is used in the process. As described, the desired moisture content level in the green sawdust $S_g$, or in the dried sawdust $S_d$, and or sawdust temperatures may be used to determine the operating parameters and to control the process.

In a specific implementation, the temperature of the output stream 113 carrying the dried sawdust $S_d$ is detected downstream of the dryer 118 using a conventional temperature sensor 132, as shown in FIGS. 1B, 2A, 2B and 8. The detected output temperature is received by a temperature controller 134 (FIG. 8) connected to the temperature sensor 132. Alternatively, a moisture sensing approach may be used.

The temperature controller 134 controls the process in response to the detected output temperature, for example based on a predetermined correlation of desired final moisture content values to output stream temperatures. The temperature controller 134 is connected to a flow controller 136, which in turn controls the flow of the input streams into the blending chamber.

In one specific implementation, the output stream temperature is controlled by varying the proportions of the "hot" input streams and the "cold" input stream relative to each other. In one such approach, the proportion of the "hot" streams, in this case the combined stream 109, and the proportion of the "cold" stream, in this case the air stream 112, are varied relative to each other. For example, the flow rate may be varied such that the mass flow rate of both streams 109, 112 together remains substantially constant. Thus, if the temperature is to be lowered, the flow of the "cold" stream may be increased, and the flow of the "hot" streams decreased by the same amount. Of course, an alternative but less efficient approach would be to vary only one stream, the "hot" stream or the "cold" stream, while the other remains constant whenever a temperature change is required.

Figure 3:
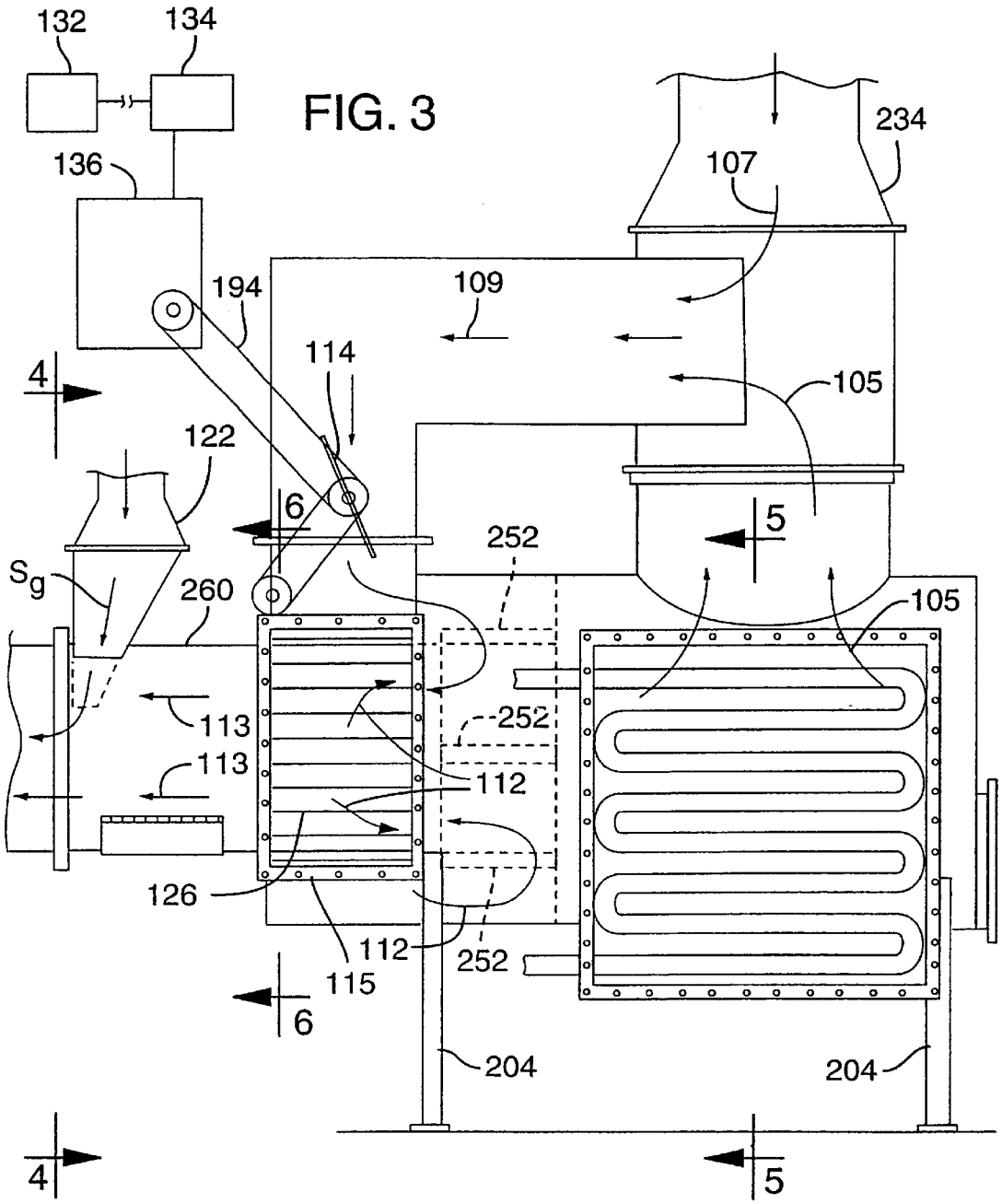
FIG. 3 is a side elevational view of one form of a blending chamber usable in the embodiments of FIGS. 1A and 1B, which also shows an exemplary position of a heat exchanger and of a form of flow control device for an ambient air stream, with the general process direction being from right to left.

In a specific implementation, such a control approach may be carried out using a linked flow control arrangement. As illustrated in FIGS. 3 and 8, the linked flow control arrangement may include conventional flow control devices, such as the first flow control device 114 and the second flow control device 115, positioned to variably change the area open to flow of the combined stream 109 and the air stream 112, respectively. For example, as shown in FIG. 3, the first flow control device 114 may be a damper 114 positioned in the passageway 222 to control the flow of the combined stream 109. The second flow control device 115 may be a set of louvers 126 positioned in the cold air inlet opening 246 to control the incoming flow of the fresh air stream 112.

In a specific implementation, as shown in FIG. 3, the first flow control device 114 and the second flow control device 115 may be mechanically interconnected by levers, a belt and pulley arrangement 194 as shown, or other structure, such that opening one of the flow control devices (allowing greater flow) is accompanied by the closing (allowing less flow) of the other flow control device. Other suitable control approaches may be used. Based on signals received from the temperature controller 134, the flow controller 136 operates the belt and pulley arrangement 194 such that the first and second flow control devices 114, 115 are respectively positioned to admit desired proportions of the hot streams and the cold stream into the blending chamber 102.

In addition to the relative amounts of the "hot" and "cold" inputs, other parameters can be varied. For example, the feed rate at which the green sawdust $S_g$ is fed through the hopper 122 and into the output stream 113 can be adjusted. If the moisture content in the dried sawdust $S_d$ is too high (i.e., the sawdust is too wet), the feed rate can be decreased (e.g., by decreasing the feed rate of the augers 142) so that less sawdust is being dried at any particular time. Specifically, the feed rate can be varied by adjusting the frequency drive controller 143 associated with the augers 142. Those of ordinary skill in the art will recognize other ways of varying control parameters, such as, e.g., varying the negative pressure generated by the fan 120 (thus affecting the rate at which fluids and particulates are drawn through the system) or varying the rate at which the dryer 118 rotates.

Alternatively, other controls may be used to affect the inputs to the blending chamber 102. As shown in FIG. 1A, the exhaust gas stream 107 flows from the boiler 110 through an exhaust stack 190. The exhaust stack 190 has an exhaust gas passage 234 through which the exhaust gas stream 107 is directed to the blending chamber 102. The exhaust stack 190 may have a flow controller, such as a barometrically-controlled damper 101 (FIG. 8) that prevents cold air from the outside from being drawn into boiler 110 and into the stream 107.

A blending chamber damper 103 (FIGS. 1A, 8) may also be positioned in the exhaust gas passage 234. The blending chamber damper 103 is operable to open or close the exhaust gas passage 234 to the flow of the exhaust gas stream 107. When the drying system 100 is to be operated, the damper 103 is configured in its "open" position.

SYSTEM INITIALIZATION AND MONITORING

At startup, various systems controls are put in a "maintenance" position, for example, the damper 103 on the exhaust stack 190 is closed, and the output stream temperature setpoint is set to 180° F. The dryer 118 and fan 120 are started to draw air across the steam coils of the heat exchanger 108 to preheat the dryer 118 for 2–3 hours. After the dryer 118 is preheated, the fan is set at its desired flow rate and the supply of green sawdust is started. The system is then reconfigured into its "run" state, and the damper 101 is opened. The rest of the system may then be started in sequence.

Factors affecting the drying process include weather, available heat to dry the sawdust and the particular species of sawdust being dried. Weather can affect drying through both temperature and relative humidity. Drying performance is better on dry, hot days and worse on cold, rainy days.

Because the boiler does not operate under a steady load, the available heat, i.e., the temperature of the exhaust gas stream 107, can vary, such as from 300–500° F. The control system described above accommodates boiler temperature variations.

The control parameters may also be adjusted according to the particular species of sawdust being dried, e.g., as described in the following examples:

(1) Ponderosa Pine has a high initial moisture content and does not readily release its moisture. Typical parameter settings are an output stream temperature (measured downstream of the dryer 118 by the temperature sensor 132) of about 190 to 200° F. and an auger frequency of about 800–1200 rpm, resulting in the introduction of green sawdust at a typical rate of about 1800 lbs/hr;

(2) Lodgepole Pine releases moisture more readily. Typical parameter settings are an output stream temperature of about 190 to 200° F. and an auger frequency of about 1200–1800 rpm, resulting in the introduction of green sawdust at a typical rate of about 2000 lbs/hr; and (3) Douglas Fir is relatively easy to dry, having a relatively low initial moisture content, and giving up moisture readily. Typical parameter settings are an output stream temperature of about 160 to 170° F. and an auger frequency of about 2000 rpm, resulting in the introduction of green sawdust at a typical rate of about 2500 lbs/hr.

MONITORING AND QUALITY CONTROL

Although automatic monitoring and semiautomatic monitoring may be used, a manual approach is also appropriate. For example, periodically, such as once each hour, an operator may take a sample (e.g. 50 gm) of the dried sawdust $S_d$, and, using a conventional "oven dry" method or other approach, determine the moisture content of the sample. The operator may then adjusts the auger frequency drive speed and/or the detected temperature as necessary to maintain or archive the desired moisture content.

According to the "oven dry" method, a sample of the sawdust being dried is removed from the dryer 118 and weighed. The sample is then heated in a microwave oven for 5 minutes, and re-weighed. The microwave treatment is repeated until there is no detectable change in sample weight between two successive iterations of microwave treatment. The percentage moisture content of the original sample is determined by taking the difference between the weight prior to microwave treatment and after microwave treatment. This difference is divided by the original sample weight, and multiplied by 100 to convert it to a moisture content percentage.

The blending chamber 102 may be made of metal or other suitable material. The other components of the system are also typically made of metal, although other materials may be substituted.

Having illustrated and described the principles of our invention with reference to several preferred embodiments, it should be apparent to those of ordinary skill in the art that the invention may be modified in arrangement and detail without departing from such principles. We claim all such modifications which fall within the scope and spirit of the following claims.

We claim:

1. A particulate material drying system for drying particulates from a source of particulates to be dried, the system comprising:

a heat source providing a primary source of heat for other than a particulate drying process and providing a secondary source of heat for use in particulate drying, the heat source having at least one heat supply outlet, the secondary source of heat being delivered in the form of at least one heated fluid from the heat source to the at least one heat supply outlet;

a blending chamber comprising at least a first heated fluid inlet coupled to the at least one heat supply outlet such that heated fluid from the at least one heat supply outlet enters the blending chamber, the blending chamber comprising a second air input through which relatively cool air is delivered to the blending chamber, wherein the heated fluid and relatively cool air is blended in the blending chamber, the blending chamber having at least one outlet from which blended fluid which has been blended in the blending chamber is delivered from the blending chamber;

a particulate dryer coupled to the blending chamber outlet and to the source of particulates such that blended fluid from the blending chamber at least partially dries the particulates in the dryer, the dryer having a dryer outlet from which at least partially dried particulates are delivered.

2. A system according to claim 1 wherein the first heat source comprises a boiler having an exhaust gas outlet, and wherein at least a portion of exhaust gases from the exhaust gas outlet comprises at least one heated fluid delivered to the at least one heat supply outlet.

3. A system according to claim 2 wherein the only heat source for drying particulates is heat from exhaust gas of the boiler.

4. A system according to claim 2 including at least one heat exchanger supplied with heat from the boiler, wherein at least one heated fluid comprises fluid heated by the at least one heat exchanger provided to the at least one heat supply outlet.

5. A system according to claim 4 wherein the only heat source for drying particulates is heated fluid heated by the at least one heat exchanger.

6. A system according to claim 1 wherein the heat source has first and second heat supply outlets, the heat source providing a first heated fluid to the first heat supply outlet and a second heated fluid to the second heat supply outlet, the heat source comprises a heat source having an exhaust gas outlet, and wherein at least a portion of exhaust gas from the exhaust gas outlet is delivered to the first heat supply outlet as the first heated fluid, at least one heat exchanger supplied with heat from the heat source, wherein the at least one heat exchanger provides the second heated fluid to the second heat supply outlet, the blending chamber comprising first and second heated fluid inlets coupled respectively to the first and second heat supply outlets, wherein the first heated fluid, the second heated fluid and the relatively cool air is blended in the blending chamber.

7. A system according to claim 6 wherein the heat source is a boiler and is the only primary source of heat for the particulate dryer.

8. A particulate drying system according to claim 1 comprising at least one fan positioned in fluid communication with and downstream of the dryer outlet, the at least one fan creating a negative pressure that draws the at least one heated fluid and relatively cool air into and through the blending chamber and draws a blended outlet stream of blended fluid and particulates through the dryer and dryer outlet; and a cyclone separator in fluid communication with and downstream of the fan, the separator receiving the blended outlet stream from the dryer and separating out the at least partially dried particulates.

9. A particulate drying subsystem that uses recycled heat energy, comprising:

a boiler that produces heat during operation;

a blending chamber connected to the boiler, the blending chamber having at least a first fluid input and a second fluid input, the first fluid input being heated by the boiler and the second fluid input being ambient air from adjacent the blending chamber, wherein at least the first and second fluid inputs are blended together into an output flow within the blending chamber and output for drying particulates.

10. The subsystem of claim 9, wherein the first fluid input comprises exhaust gas produced from operation of the boiler.

11. The subsystem of claim 9, wherein the first fluid input comprises exhaust gas produced from operation of the boiler and warmed by operation of the boiler.

12. The subsystem of claim 11, wherein the boiler includes a steam circuit and air is warmed through a heat exchange with the steam in the steam circuit.

13. A sawdust drying subsystem that uses heat energy recycled from a boiler, comprising:

a boiler steam circuit and an associated exhaust gas outlet through which heated exhaust gas from operating the boiler are released;

a radiator positioned in the steam circuit, wherein steam from the boiler circulates through the radiator and releases heat to heat air drawn through the radiator to provide a source of warmed air; and a blending chamber having an exhaust gas input and a warmed air input positioned adjacent the radiator through which the exhaust gas and warmed air, respectively, are drawn into the blending chamber, wherein at least the warmed air and the exhaust gas are blended together within the blending chamber into an output stream for drying sawdust.

14. The subsystem of claim 13, wherein the blending chamber further comprises an ambient air input, and wherein ambient air received through the ambient air input is blended into the output stream of the blending chamber together with the warmed air and the exhaust gas.

* * * * *